US005390519A

United States Patent [19]

Kuroda et al.

[11] Patent Number: 5,390,519

[45] Date of Patent: Feb. 21, 1995

[54] METHOD FOR MANUFACTURING LONG PRODUCTS BY PRESS WORKING

[75] Inventors: Yoshitaka Kuroda, Anjo; Takao Ikeda, Okazaki; Kazutoshi Yamamoto, Matsumoto; Tamotsu Inoue, Nagoya, all of Japan

[73] Assignee: Nippondenso Co., Ltd., Kariya, Japan

[21] Appl. No.: 155,738

[22] Filed: Nov. 22, 1993

[30] Foreign Application Priority Data

Nov. 27, 1992 [JP] Japan ..... 4-318999

[51] Int. Cl.[6] ..... B21D 43/00; B21D 53/04; B21D 28/20

[52] U.S. Cl. ..... 72/16; 72/334; 29/890.052

[58] Field of Search ..... 72/16, 9, 336, 334, 72/404; 29/890.052

[56] References Cited

U.S. PATENT DOCUMENTS 3,248,916 5/1966 Kenyon ..... 72/16
4,622,835 11/1986 Bisson ..... 72/16
4,672,830 6/1987 Tsukamoto ..... 72/16
4,887,343 12/1989 Ohishi ..... 72/16

FOREIGN PATENT DOCUMENTS 3-264139 11/1991 Japan .
4-43298 2/1992 Japan .

*Primary Examiner*—Daniel C. Crane
*Attorney, Agent, or Firm*—Cushman, Darby & Cushman

[57] ABSTRACT

A method for manufacturing long products from a lengthy plate-like material having an appreciably small thickness by press working is disclosed in which the plate-like material is fed in succession into the press working stages of a single press unit carrying out a centering process, a bending process, a coining process, a sizing process, perforating process, and a final shearing process. The material having passed these press working processes is formed into long products having various required lengths and various required number of perforations formed therein. The spacing of the perforations are kept constant irrespective of changes in the thickness and width of the material.

8 Claims, 15 Drawing Sheets

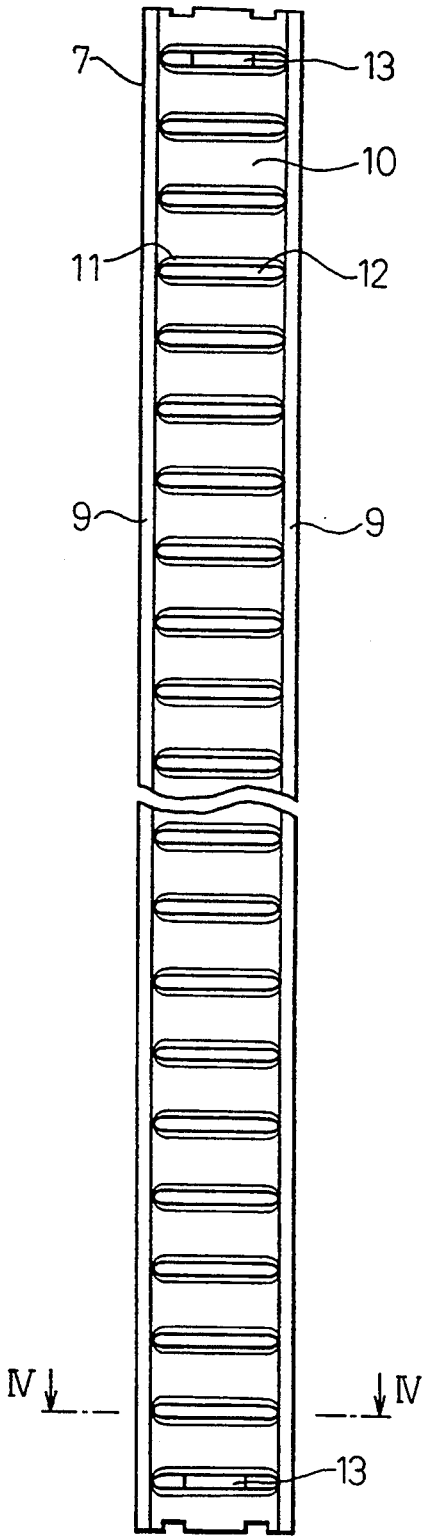
Fig.4A
Fig.4B
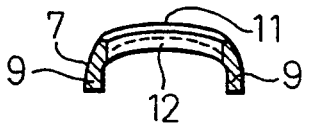

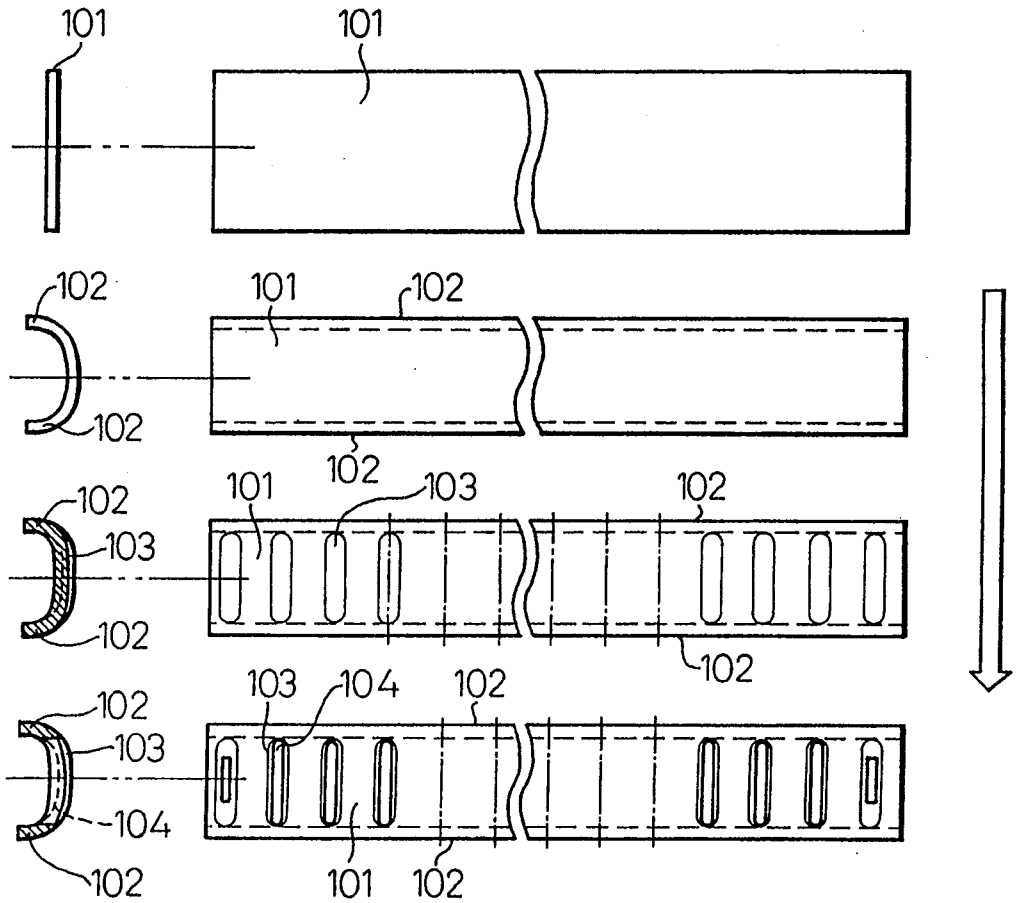
Fig.16 (A) (PRIOR ART)
Fig.16 (B) (PRIOR ART)
Fig.16 (C) (PRIOR ART)
Fig.16 (D) (PRIOR ART)

METHOD FOR MANUFACTURING LONG PRODUCTS BY PRESS WORKING

BACKGROUND OF THE INVENTION

1. Field of the Invention

The present invention relates to a press working method for continuously manufacturing products having various different lengths depending upon demand and a small thickness. More particularly, it relates to a method of manufacturing thin but lengthy metallic products by press working from a plate-like material fed from a source of material such as a roll of substantially thin metallic strip. The present invention is preferably but non-exclusively applicable to press working processes for manufacturing header plates used as parts of a refrigerant condenser accommodated in an air-conditioning apparatus.

2. Description of the Related Art

It is well known that when a thin but lengthy metallic product is manufactured from a plate-like metallic workpiece by a press working including bending, coining, and perforating processes, the workpiece is apt to be undesirably stretched in a longitudinal direction thereof, i.e., in the direction corresponding to a direction in which the metallic raw workpiece is fed during the bending and coining processes. Further, the amount of stretch of the workpiece in the longitudinal direction thereof varies depending on a change in the width and thickness of the plate-like workpiece, and accordingly, positions of the workpiece to which the coining working is applied are often out of registration with positions to which the perforating working is applied. Moreover, spacings between two neighboring perforations cannot be constant. Consequently, high-quality press work products cannot be obtained.

In order to obviate the above-mentioned defects encountered by the conventional press working method, several proposals have been provided. For example, Japanese Unexamined Patent publications (Kokai) Nos. 3-264139 and 4-43298 disclose an improved method of manufacturing assembling parts of an heat exchanger for a car air-conditioning apparatus by using a press working method.

FIG. 16 schematically illustrates the above-mentioned improved press working method adopted for manufacturing the assembling parts of the heat exchanger according to the disclosure of the two Japanese publications.

Referring to FIG. 16, a flat, plate-like workpiece 101 having predetermined width and length is prepared at a preparatory stage (A) by severing a metallic raw material. Subsequently, the workpiece 101 is fed in a direction shown by an arrow, which is perpendicular to the longitudinal direction of the workpiece 101, into a press machine provided with transfer-type dies or robotic dies.

In the press machine, the workpiece 101 is initially subjected to a bending process (B) in which the workpiece 101 is formed with bent portions 102 on both sides thereof. The workpiece 101 is further subjected to a coining process (C) and to a perforating process (D) at substantially the same time. In the coining and perforating processes (C) and (D), a plurality of concavities 103 are formed in an intermediate portion of the workpiece 101 between the bent portions 102 by applying a compression to the intermediate portion, and a plurality of perforations 104 are punched in respective concavities 103 of the workpiece 101.

Nevertheless, in the above-mentioned known press working method, when products having many different lengths (for example, header plates having 40 different lengths are conventionally used for assembling various refrigerant condensers of air-conditioning apparatuses.) are manufactured, respective pressing dies for respective products of different lengths are required, and accordingly, a production cost for respective pressing dies must greatly increase.

Moreover, when a press working of the products is daily carried out, a preparatory process for changing pressing dies must be repeated many times according to demand resulting in interruption of the press working process. Namely, a lot of time must be consumed by changing the pressing dies every day. As a result, the rate of operation of the respective pressing dies is low.

SUMMARY OF THE INVENTION

Therefore, an object of the present invention is to provide a further improved press working method for manufacturing products having a small thickness but different substantial lengths from a raw metallic plate in the form of a thin and lengthy metallic strip.

Another object of the present invention is to provide a method of manufacturing a variety of lengthy products from a strip-like metallic plate by press working which can reduce the cost of production of pressing dies and can increase the rate of operation of respective pressing dies.

In accordance with the present invention, there is provided a method for manufacturing products having various substantial lengths by press working from a lengthy strip-like material of given thickness and width and successively fed from a raw material source into a press means in a direction corresponding to a longitudinal direction of the strip-like material, comprising a plurality of successive pressing steps which include:

a preforming step in which the continuously fed lengthy strip-like material is successively pressed in a manner such that respective first predetermined longitudinal portions thereof are formed in a predetermined preliminary shape, respectively;

a correcting step in which said respective predetermined longitudinal portions of the continuously fed lengthy strip-like metallic material having said predetermined preliminary shape are successively compressed by a force determined depending on the given thickness and width of the lengthy strip-like metallic material so as to correct the size of the second predetermined longitudinal portions of said lengthy strip-like metallic material in a manner such that a desired amount of stretch of each said second predetermined longitudinal portion is provided in a direction corresponding to a direction of length of said each second predetermined portion of said lengthy strip-like metallic material, and;

a finishing step in which a plurality of perforations are formed in a predetermined positions of said lengthy strip-like metallic material after completion of said correcting step, and in which said lengthy strip-like metallic material after said correcting step and formed with said plurality of perforations is successively sheared so as to produce therefrom finished products having various lengths determined by demand.

In accordance with the above-defined press working method, a lengthy strip-like material, preferably, a lengthy metallic strip having a preselected width and a given appreciably small thickness is successively fed into the press means, e.g., a transfer press unit provided with a variety of sequential press working stages, i.e., the preforming stage, the correcting stage, and the finishing stage. The preforming stage includes bending and coining stages, the correcting stage includes a sizing stage, and the finishing stage includes perforating and shearing stages.

In the bending stage, the lengthy strip-like material is bent by bending dies at the laterally opposite side portions thereof in a manner such that opposite lateral edges of the strip-like material are bent toward each other to thereby form bent portions in the laterally opposite side portions of the material. In the coining stage, a plurality of predetermined longitudinal positions of an intermediate planar portion of the strip-like material extending between the bent portions are subjected to a constant compressing force to thereby be formed with concavities therein.

In the sizing stage, the intermediate planar portions having the concavities and the opposite bent portions are individually subjected to separate compressing forces determined, respectively, depending on the thickness and width of the strip-like material to thereby give a predetermined amount of longitudinal stretch to the strip-like material. Thus, the concavities coined in the intermediate planar portion of the material are equidistantly arranged in the longitudinal direction of the material.

In the perforating stage, a plurality of perforations are formed by predetermined dies and punching tools in the equidistantly arranged concavities of the intermediate planar portion of the material.

In the final shearing stage, the strip-like material formed with the bent portions and the perforations is sheared to obtain products, each having a predetermined number of perforations and a predetermined length. The number of perforations and the length of each product are determined by demand.

BRIEF DESCRIPTION OF THE DRAWINGS

The above and other objects, features and advantages of the present invention will be made more apparent from the ensuing description of a preferred embodiment thereof with reference to the accompanying drawings wherein:

FIG. 4A is a flat view of the header plate manufactured by the method according to the embodiment of the present invention, and accommodated in the refrigerant condenser of FIG. 1;

FIG. 4B is a cross-sectional view taken along the line IV—IV of FIG. 4A;

FIG. 16 is a diagrammatic view, illustrating press working stages according to a prior art.

DESCRIPTION OF THE PREFERRED EMBODIMENTS

Figure 1:
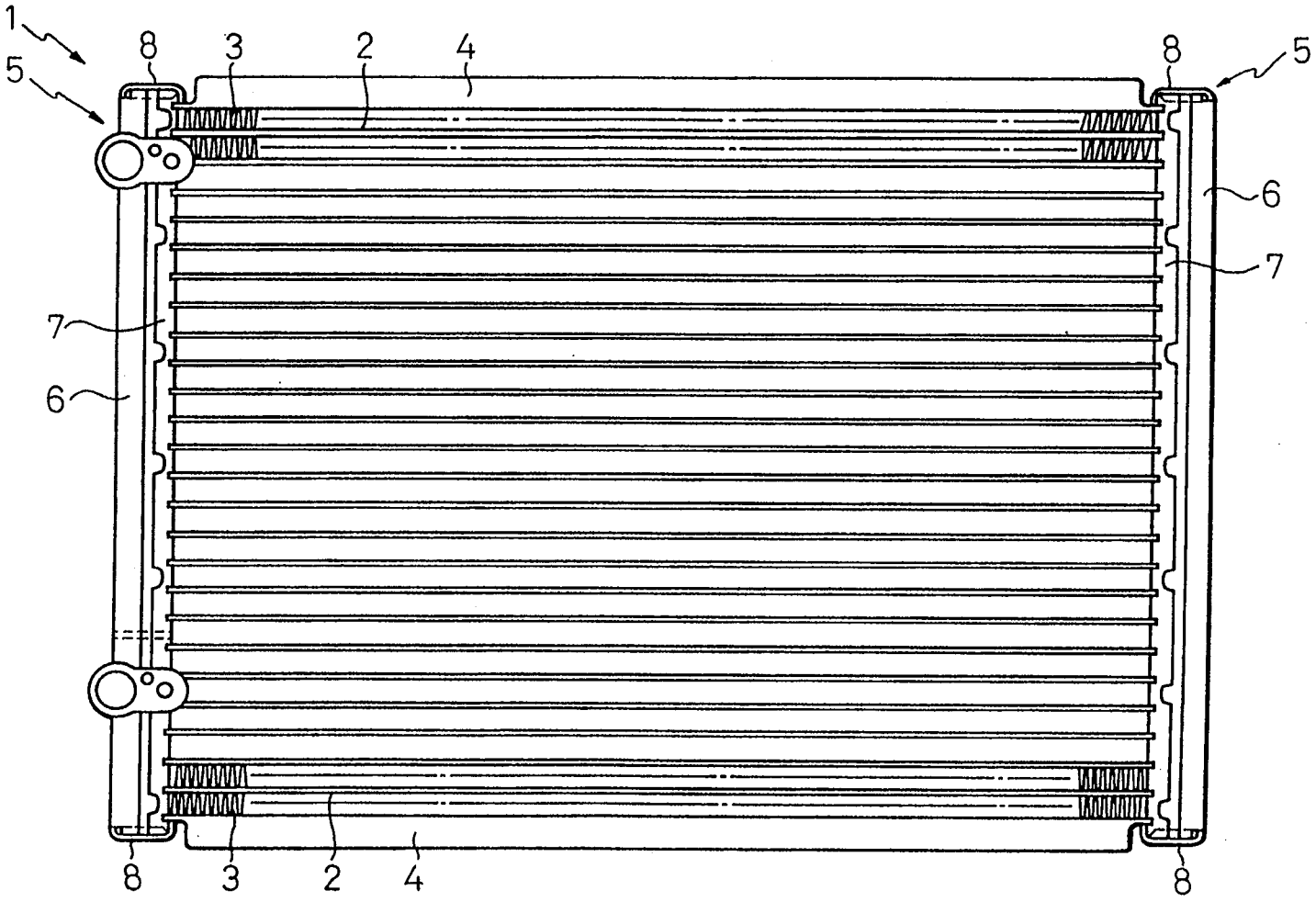
FIG. 1 is a front view of a refrigerant condenser for an air-conditioning apparatus, which accommodates therein header plates manufactured by a press working method according to an embodiment of the present invention.
Figure 2:
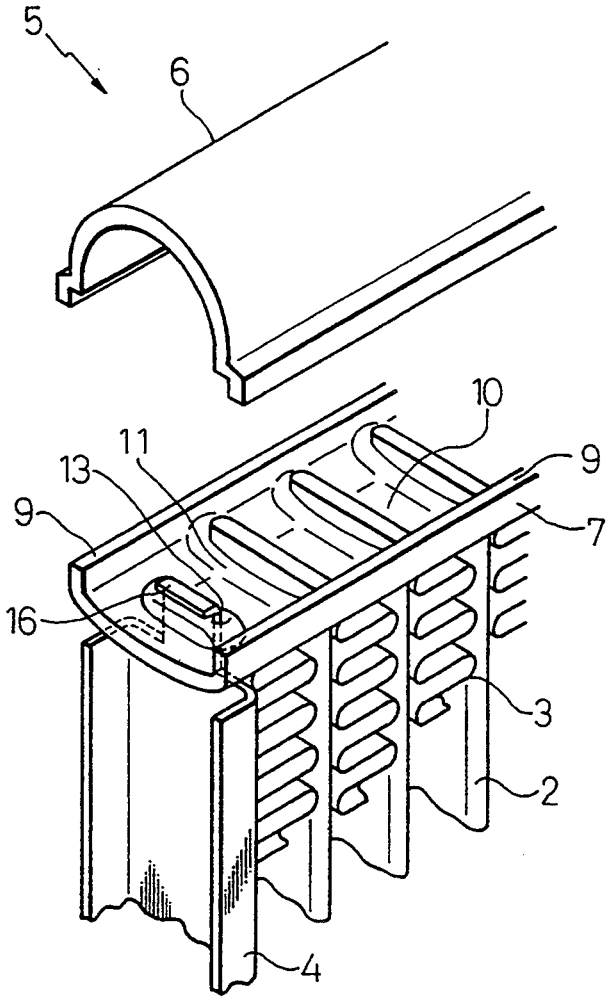
FIG. 2 is a partial perspective view of an important portion of the refrigerant condenser of FIG. 1.
Figure 3:
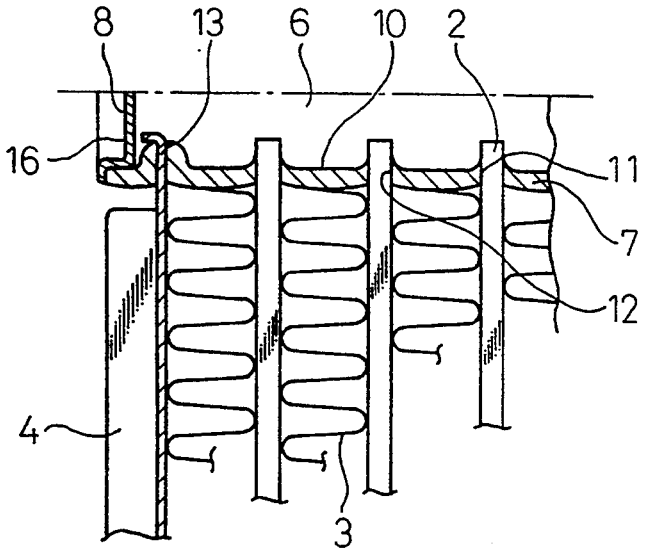
FIG. 3 is a partial cross-sectional view of the refrigerant condenser of FIG. 1.

Referring to FIGS. 1 through 3, a refrigerant condenser 1 accommodated in a car air-conditioning apparatus is provided with a plurality of tubular elements 2, corrugated fins 3, side plates 4, and header elements 5. The tubular elements 2 and the corrugated fins 3 are assembled and stacked in an alternate manner as best shown in FIG. 1. The assembly of the tubular elements 2 and the corrugated fins 3 is sandwiched between the side plates 4, and the upper and lower ends of the assembly are fixedly connected to the header elements 5 by the welding method.

The tubular elements 2 are made of metallic material such as aluminum alloy and, having fluid-passageways therein, permit a refrigerant to flow therethrough to thereby cause condensation and liquefaction of the refrigerant due to heat exchanging between the refrigerant in the tubular elements 2 and the air flowing outside the tubular elements 2.

The corrugated fins 3 are made of thin metallic material such as a thin aluminum alloy plate, and have a corrugated shape. Each corrugated fin 3 is provided with non-illustrated louvers attached to the surface thereof to increase the heat exchanging efficiency of the corrugated fin 3.

The side plates 4 made of metallic material such as aluminum alloy are arranged so as to hold a core configuration of the assembly of the tubular elements 2 and the corrugated fins 3. The side plates 4 can also function as a bracket to mount the refrigerant condenser 1 in the engine compartment of a car.

As best shown in FIG. 2, the header element 5 arranged on each of the upper and lower sides of the refrigerant condenser 1 is provided with an outer tank plate 6 having a semi-circular cross-section and an inner header plate 7 having a U-shape cross-section. The tank plate 6 and the header plate 7 are mated together to form the header element 5 having a substantially cylindrical shape. Each header element 5 is provided with longitudinally spaced open ends which are covered and closed by caps 8 shown in FIGS. 1 and 3.

Figure 5:
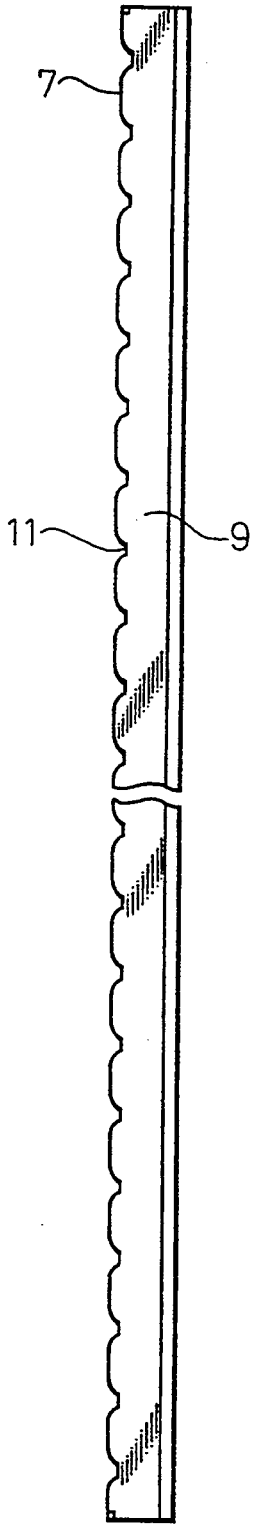
FIG. 5 is a side view of the header plate of FIGS. 4A and 4B, illustrating the overall configuration of the header plate.

Referring to FIGS. 4A, 4B and 5, a pair of header plates 7 made of a metallic material such as an aluminum alloy is connected to axial opposite ends of the plurality of tubular elements 2 by an appropriate connecting method such as welding method. Both lateral sides of each header plate 7 are bent to form bent portions 9 over an entire axial length. Namely, the bent portions 9 on both lateral sides are formed by bending the lateral side edges toward each other as best shown in FIG. 4B in a manner such that the bent portions 9 are mated with the cooperating portions formed in lateral both sides of the afore-mentioned tank plate 6 (FIG. 2). Thus, the header plate 7 is connected to the tank plate 6. The header plate 7 is provided with a substantially planar bottom portion 10 extending axially, and is arranged intermediately between both bent portions 9. The planar bottom portion 10 of the header plate 7 is provided with a plurality of lateral concavities 11 disposed at equal spacing in the axial or longitudinal direction. Further, each concavity 11 of the header plate 7 is provided with a perforation or through-hole 12 in the form of an elongated circle or an ellipse for receiving an end of the tubular element 2. The planar bottom portion 10 of the header plate 7 is also provided with perforations or through-holes 13 formed in the two concavities 11 located adjacent to axially extreme ends of the header plate 7, and positioned at axially outside the above-mentioned elliptical perforations 12. The two perforations 13 of the header plate 7 are provided for receiving ends of the side plates 4 (FIGS. 1 and 2).

The description of the method for manufacturing products from a planar material according to an embodiment of the present invention will be provided hereinbelow with reference to FIGS. 6 and 7.

Figure 6:
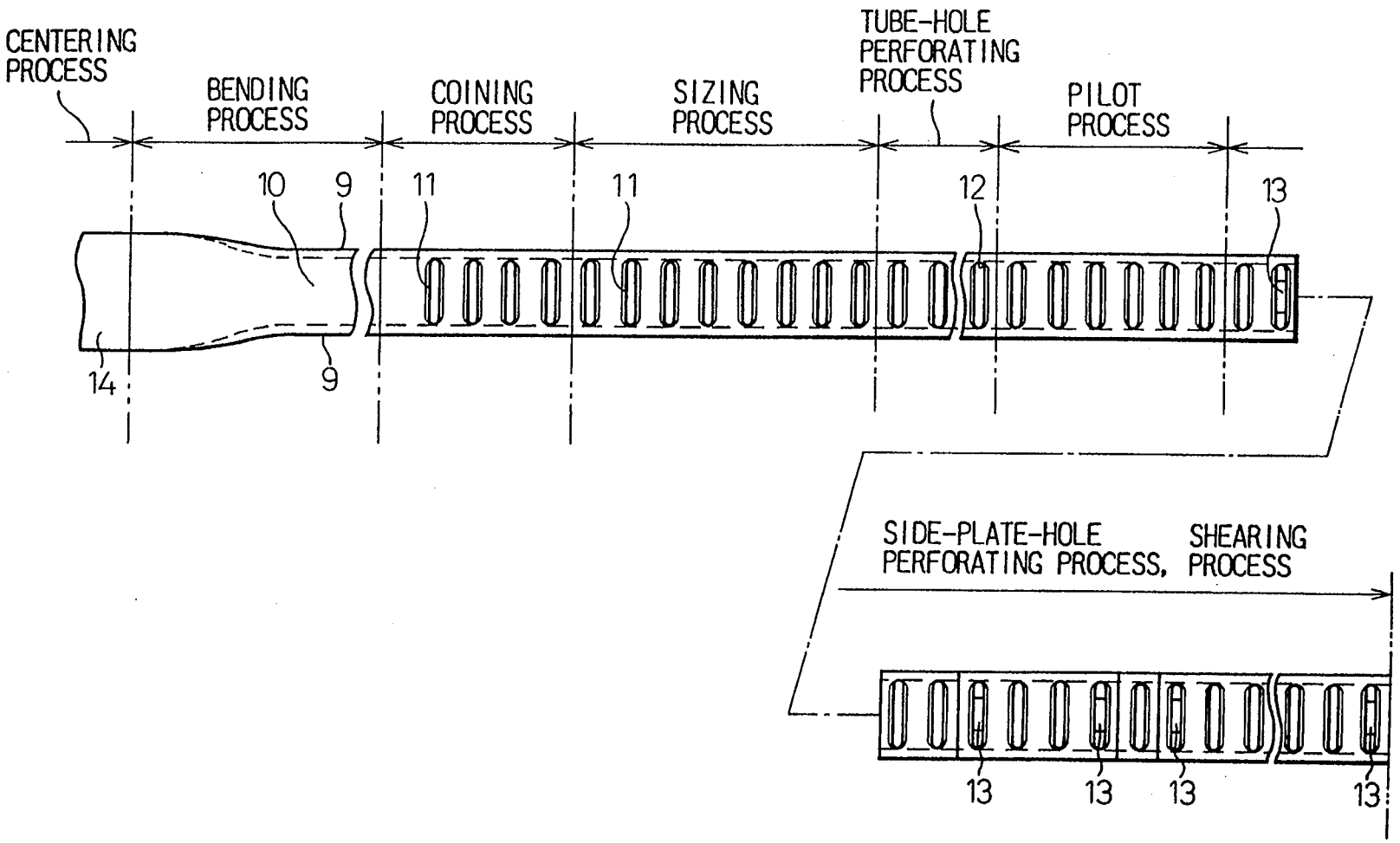
FIG. 6 is a diagrammatic flat view illustrating press working processes employed for manufacturing of the header plate from a successively fed lengthy strip-like metallic material according to the present invention.
Figure 7:
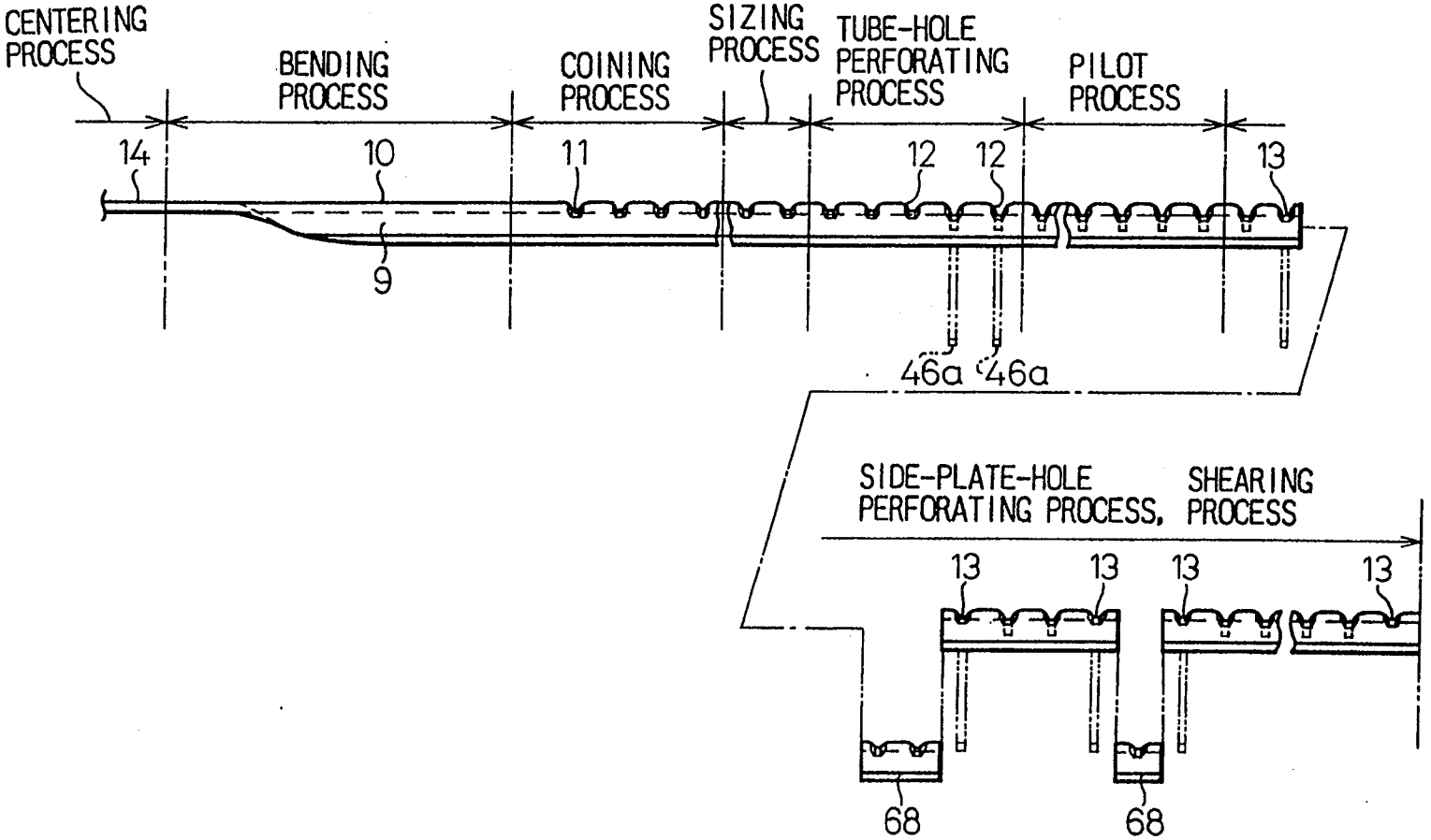
FIG. 7 is a diagrammatic side view illustrating press working processes the same as those of FIG. 6.

Referring to FIGS. 6 and 7, a plate-like metallic material 14 in the form of a continuous thin metallic strip is fed in succession by an appropriate feeding unit toward a progressive type press unit provided with a plurality of press working stages 15 (see FIG. 10) at a constant feeding pitch, and is successively subjected to a plurality of press working processes including a centering process, a bending process, a coining process, sizing process, a tube-hole perforating process, a pilot process, a side-plate-hole perforating process, and a shearing process. In respective press working stages 15, there are provided dies and associated tools required for conducting the above-mentioned processes. Thus, when the metallic material 14 passes respective press working processes, products, e.g., the aforementioned header plates 7 are successively manufactured, and delivered from the output end of the press unit.

As shown in FIGS. 6 and 7, when the plate-like metallic material 14 initially enters the press working stage 15 for carrying out the centering process, the position thereof is adjusted at a predetermined position under the guide of four guide rollers.

Figure 8:
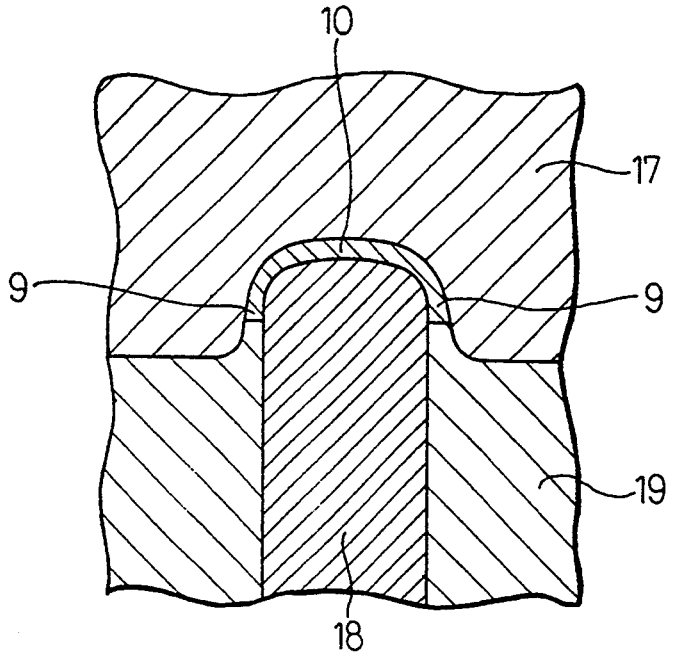
FIG. 8 is a partial cross-sectional view, illustrating a bending stage in which a bending process of a worked material is carried out by a press unit, for example, a transfer press to implement the manufacturing method according to the embodiment of the present invention.

The plate-like metallic material 14 is subsequently fed toward the press working stage 15 for carrying out the bending process in which the material 14 is downwardly bent at the lateral side portions thereof by a die 17, a punch 18 and a die plate 19, so that the lateral side portions are rounded to thereby form the bent portions 9, as shown in FIGS. 6 through 8.

Figure 9:
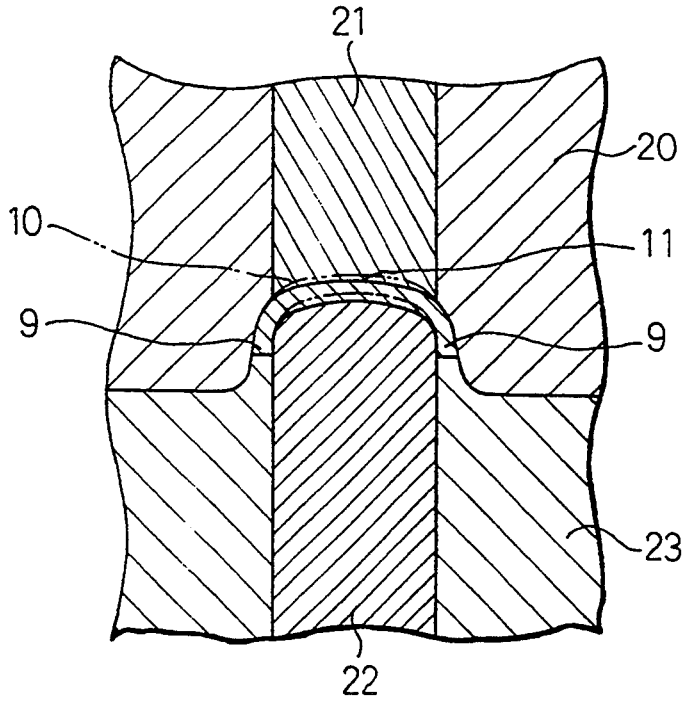
FIG. 9 is a partial cross-sectional view, illustrating a bending stage in which a coining process the worked material is carried out by the press unit.

The metallic material is subsequently fed toward the press working stage 15 for carrying out the coining process (FIGS. 6 and 7) in which the material 14 is compressed at a plurality of longitudinally equidistantly spaced positions of the planar bottom portion 10 thereof by a die 20, a pin 21, a punch 22, and a punch plate 23 shown in FIG. 9, so that the compressed positions are concave in the direction of thickness of the material 14. Namely, a plurality of concave portions are formed and disposed in the direction parallel to a direction in which the bent portions 9 extend.

Figure 10:
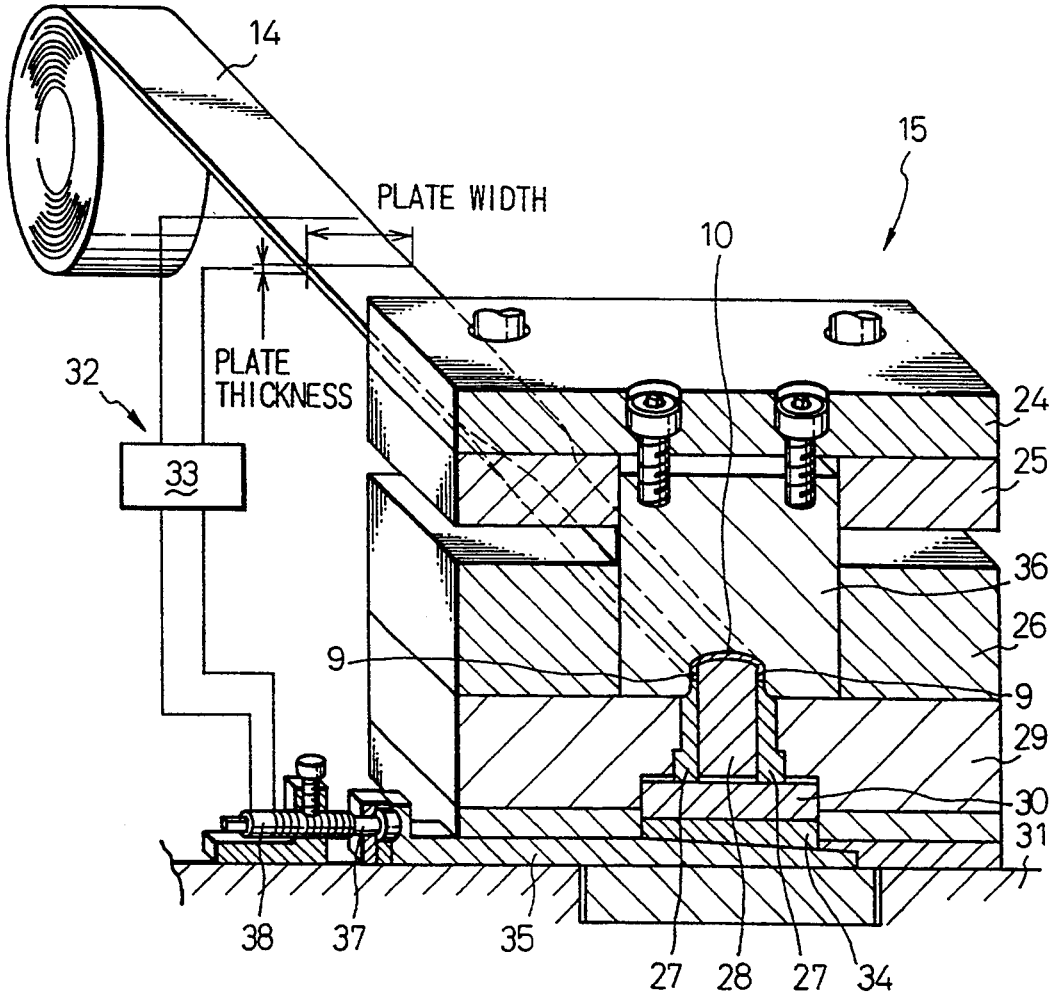
FIG. 10 is a partial perspective view, illustrating a sizing stage in which a sizing process of the worked material is carried out by the press unit.
Figure 11:
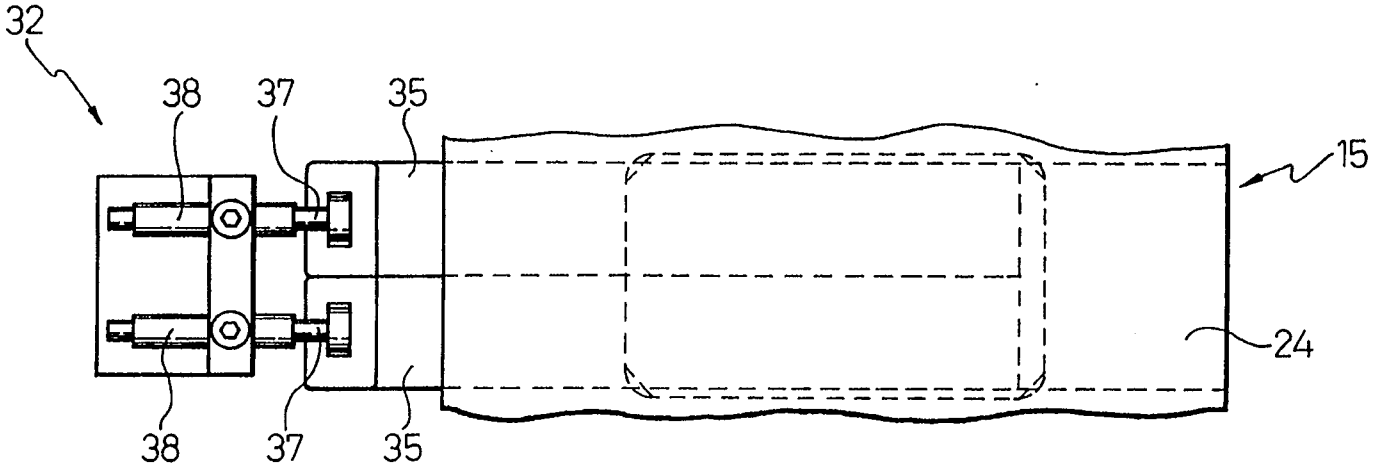
FIG. 11 is a flat view of the sizing stage, taken along the line X I—X I of FIG. 10.

When the metallic material 14 is forwarded to the subsequent press working stage 15 for carrying out the sizing process shown in FIGS. 6 and 7, the bent portions 9 and the bottom planar portion 10 of the metallic material 14 are individually compressed in the direction corresponding to the direction of thickness of the material 14. Namely, as shown in FIGS. 10 and 11, the sizing process is conducted by a die 36, an adjusting screws 37, an upper platen 24, a die plate 25, a stripper 26, a pair of compressing punches 27 compressing the bent portions 9, a compressing punch 28 compressing the planar bottom portion 10, a punch plate 29, a base 30, a lower platen 31, and two compression adjusting mechanisms 32. When the bent portions 9 and the bottom planar portion 10 are compressed, respectively, the metallic material 14 is stretched longitudinally, and is corrected in its longitudinal length.

The two compression adjusting mechanisms 32 are used for setting respective optimum compression to be applied individually to the bent portions 9 and the bottom planar portion 10 depending on the width and thickness of the plate-like metallic material 14, respectively. Therefore, the two compression adjusting mechanisms 32 are provided with an automatic measuring unit 33 for automatically measuring the width and thickness of the plate-like metallic material 14, a cam plate 34 arranged beneath the base 30 and having a slanted face operative as a cam surface, movable plates 35 having a slanted face cooperative with the slanted face of the cam plate 34, respectively, and movable in the direction substantially normal to the feeding direction of the material 14, and a pair of air cylinder means (not shown in FIGS. 10 and 11) having pistons 38 connected to the movable plates 35 so as to laterally move the movable plates 35 in response to electrical signals generated by the automatic measuring unit 33. The two compression adjusting mechanisms 32 are mounted on the lower platen 31 and are able to move the base 30 up and down.

Referring to FIGS. 6, 7, 12 and 13, the press working stage 15 for carrying out the perforating process is arranged to perforate the tube-receiving elliptical perforations 12 in the concavities 11 of the bottom planar portion 10 of the metallic material 14. The stage 15 for carrying out the perforating process is therefore provided with perforating punches 40, a punch plate 41, a die plate 42, an upper platen 43, a die 44, and a lower platen 45, and an intermittent motion mechanism 46.

The elliptical perforations 12 are formed in the plurality of concavities 11 disposed longitudinally in the bottom planar portion 10 of the material 14. The die 44 and the lower platen 45 are provided with vertical through-holes 47 and 48, respectively, for ejecting cut pieces 46*a* outside the press working stage 15 when the perforations 12 are formed.

The intermittent motion mechanism 46 is mounted on the upper platen 43 and provided with rods 49 operatively connected to the perforating punches 40, a cam plate 50 for pressuring the rod 49, an air cylinder 52 having a piston 51 connected to the cam plate 50. The air cylinder 52 operates the piston 51 in the direction normal to the feeding direction of the material 14, i.e., in the right and left-hand directions in FIG. 12. Namely, in response to the operation of the air cylinder 52, the rods 49 are intermittently moved up and down so as to intermittently pressurize the perforating punches 40.

Figure 12:
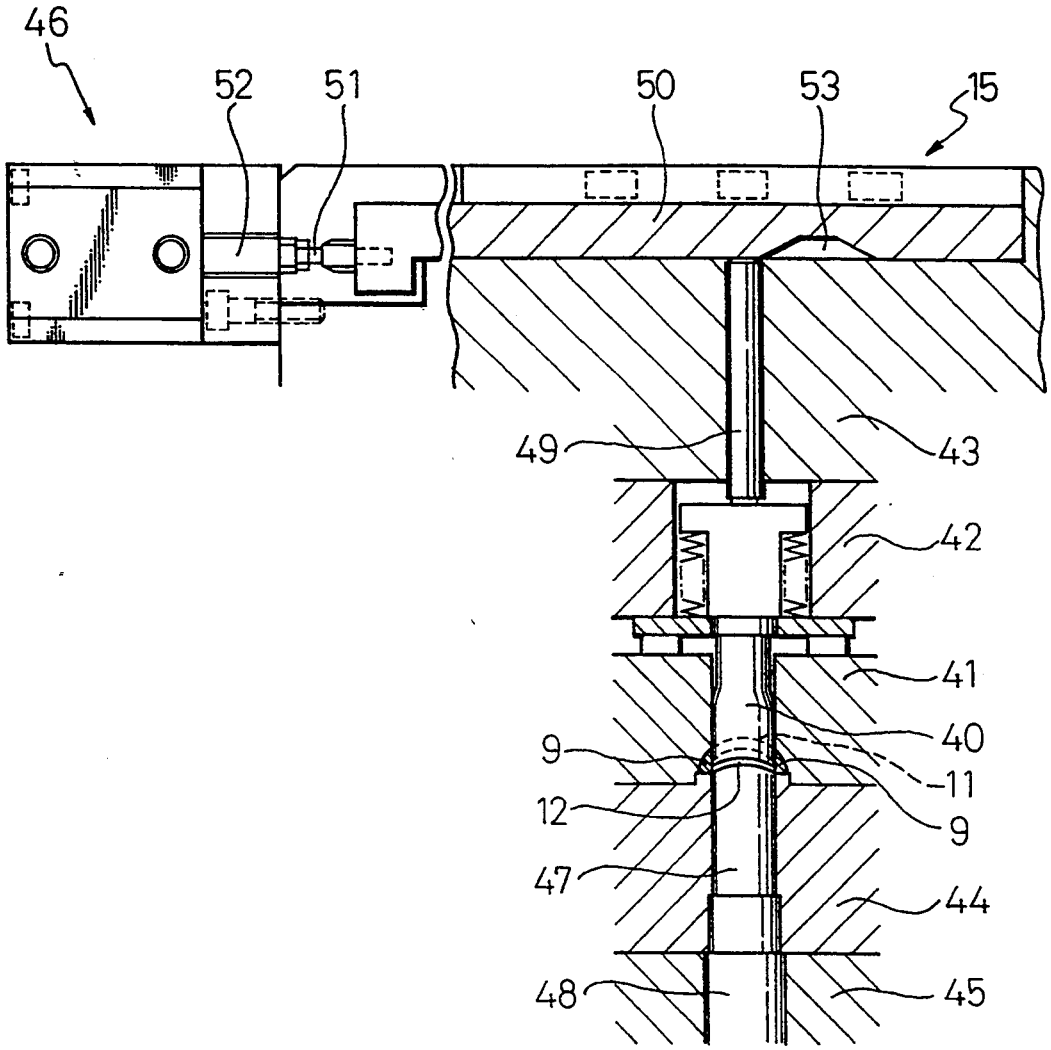
FIG. 12 is a partial cross-sectional view, illustrating a perforating stage in which a first group of perforations such as tube-holes are perforated in the worked material (the strip-like metallic material) by the press unit.
Figure 13:
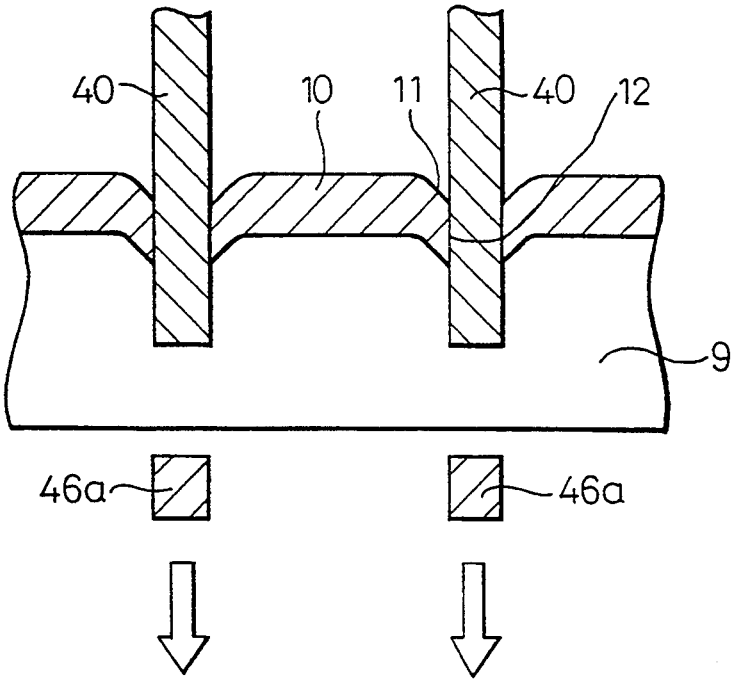
FIG. 13 is another partial cross-sectional view, illustrating the same perforating stage as that shown in FIG. 12.

When the pressurized air is pumped into the air cylinder 52, the piston 51 is moved in the left-hand direction in FIG. 12 so as to move the cam plate 50 in the same direction. Therefore, even if when the die platens of the press is closed at this stage 15, a recess 53 of the cam plate 50 receives the rod 49 therein. Thus, the perforating punches 40 are unable to perforate the material 14. When the pressurized air is exhausted from the air cylinder 52, the piston 51 is moved in the right-hand direction in FIG. 12 by a spring means encased in the air cylinder 52 to the normal operating position thereof, and accordingly, the cam plate 50 is returned to the operating position thereof.

In the press working stage for carrying out the pilot process, two pilot punches (not shown in the drawing) are arranged at positions corresponding to the two elliptical perforations 12. Thus, when the two pilot punches are engaged in the perforations 12, the metallic material 14 is prevented from being shifted from the correct position thereof. The pilot punches are mounted on an upper platen (not shown in the drawings) and intermittently moved up and down in a manner similar to the above-mentioned perforating punches 40.

Figure 14:
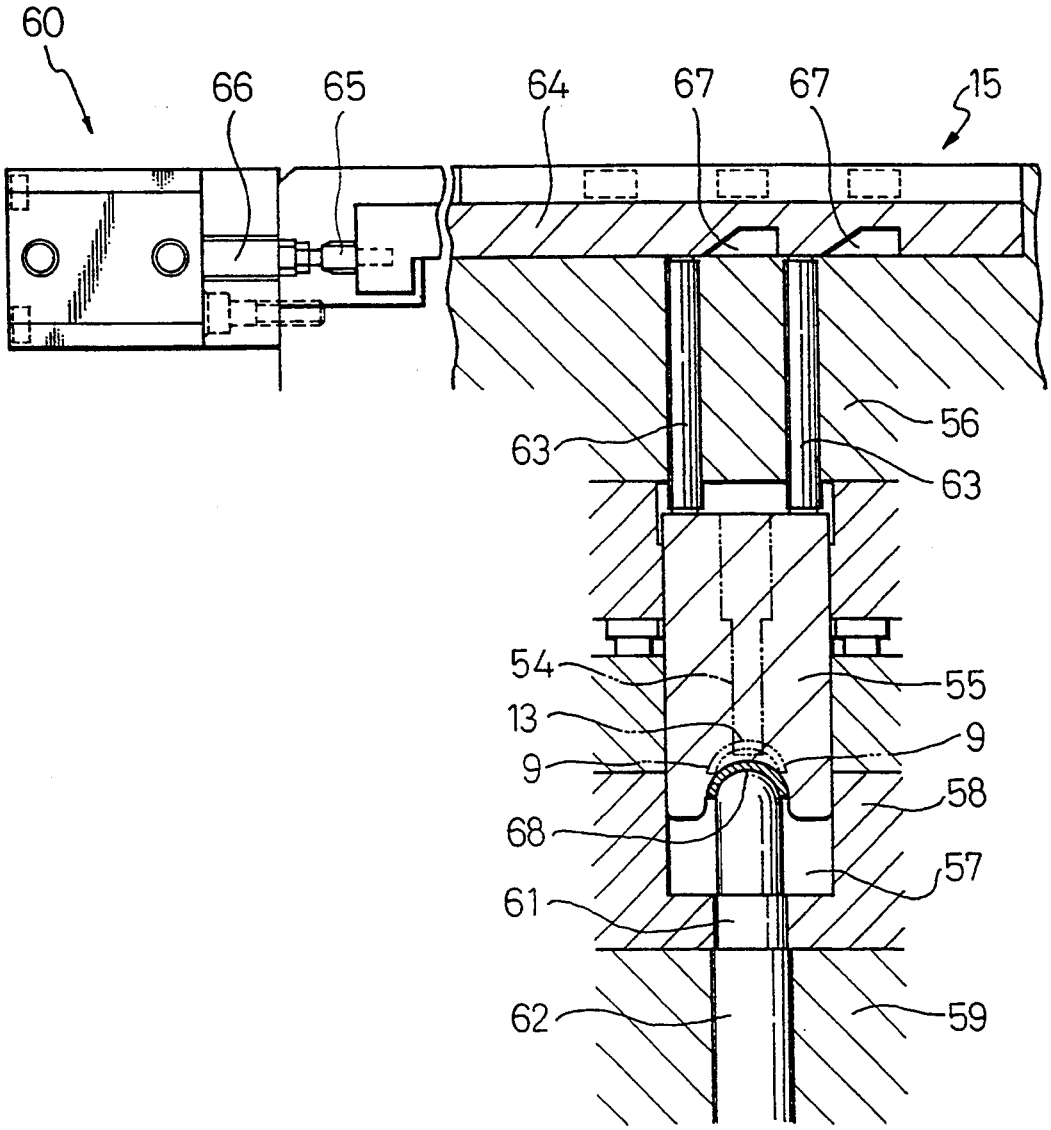
FIG. 14 is a partial cross-sectional view, illustrating both perforating and shearing stages in which a second group of perforations such as side-plate-holes are perforated in the worked material and the worked material is subsequently sheared so as to obtain a final product, i.e., a header plate having a desired length and a desired number of perforations.

As shown in FIGS. 6, 7 and 14, in the press working stage 15 for carrying out the perforating process in which the perforations 13 for receiving side plates 4 (FIGS. 1 and 2) are formed and for carrying out the shearing stage in which the material 14 is successively sheared, there are provided perforating punches 54, a shearing punch 55, an upper platen 56, a die 57, a die plate 58, a lower platen 59 and an intermittent motion mechanism 60. In this stage 15, the material 14 is sheared by the shearing punches 55 into products having a predetermined length and a predetermined number of elliptical perforations 12, i.e., a plurality of header plates 7 is obtained. The number of the elliptical perforations 12 may be either an even number or an odd number depending on demand. The sheared products are simultaneously subjected to the perforating process in which the perforations 13 are formed by the perforating punches 54 in the concavities 11 located in the extreme ends of respective products.

The die plate 58 and lower platen 59 are provided with through-holes 61 and 62, respectively, for ejecting cut pieces 68 (FIG. 7) out of the press working stage 15.

The intermittent motion mechanism 60 mounted on the upper platen 56 is provided with a pair of rods 63, operatively connected to the perforating punches 54 and the shearing punches 55, a cam plate 64 for pressuring the cam plate 64, and an air cylinder 66 having a piston 65 movable in the right-hand and left-hand directions in FIG. 14. The intermittent motion mechanism 60 having the above-mentioned elements operates the pair of rods 63 so as to intermittently move up and down.

When the pressurized air is pumped into the air cylinder 66, the cam plate 64 is moved by the piston 65 in the left-hand direction in FIG. 12, and accordingly, the cam plate 64 is pulled to a position where two recesses 67 receive the pair of rods 63 even if the die platens are closed. As a result, the perforating punches 54 and the shearing punches 55 are unable to perform perforating and shearing operations, respectively, against the products.

When the pressurized air is exhausted from the air cylinder 66, the piston 65 is moved in the right-hand direction in FIG. 14 by a spring encased in the air cylinder 66. Thus, the cam plate 64 is returned to the normal operating position.

A further description of the method for manufacturing the header plates 7 is provided below with reference to FIGS. 6 through 14.

(The centering process)

As shown in FIG. 10, a lengthy metallic strip-like material 14 having an appreciably small thickness and formed in a roll of material (a material source) is successively fed at a constant spacing by a feeding means in the direction corresponding to the length of the material 14 toward the press provided with a plurality of press working stages 15. In the centering process, the four guide rollers guide the material 14 so that the material 14 is constantly forwarded along a predetermined center position of the press working stage 15 without being shifted in the lateral direction from the centered position.

(The bending process)

The strip-like material 14 having passed through the preceded centering process is successively forwarded by a feeder means toward the subsequent press working stage 15 for carrying out the bending process. Namely, as shown in FIGS. 6 through 8, the strip-like material 14 is pressurized by the die 17 and the punch 18 in response to the closing of the upper and lower platens (not shown in FIG. 8), and accordingly, the lateral side portions of the material 14 are bent downwardly to form bent round portions. Namely, the two roundly bent portions 9 and an intermediate bottom portion 10 in the form of a substantially planar plate are formed in the planar material 14.

(The coining process)

The material 14 having passed through the bending process is successively fed by the feeder means toward the subsequent coining process. Namely, as shown in FIGS. 6, 7 and 9, the strip-like material 14 is pressurized by the die 20, the pin 21, and punch 22 in response to the closing of the upper and lower platens (not shown in FIG. 9), and accordingly, the bottom planar portion 10 of the material 14 is compressed in the direction of thickness thereof at a plurality of positions thereof. Accordingly, a plurality of concavities 11 are formed in the bottom planar portion 10 so as to be disposed in a longitudinal direction parallel with both bent portions 9.

(The sizing process)

When the strip-like material 14 passes through the above-mentioned bending and coining processes, it is subjected to compression in a direction corresponding to the direction of thickness of the material 14, and accordingly, the strip-like material 14 is stretched in the longitudinal direction thereof. Moreover, since the compression applied to the material during the coining process varies in response to a change in the thickness of the material 14, the amount of stretching of the material 14 changes. Therefore, the material 14 fed by the feeder means at a constant feeding pitch may change in its feeding pitch due to the longitudinal stretching of the material while passing the bending and coining processes. Thus, if the material 14 is further fed toward the perforating process without correcting the feeding pitch, the spacing between the neighboring perforations 12 cannot be constant.

Figure 15:
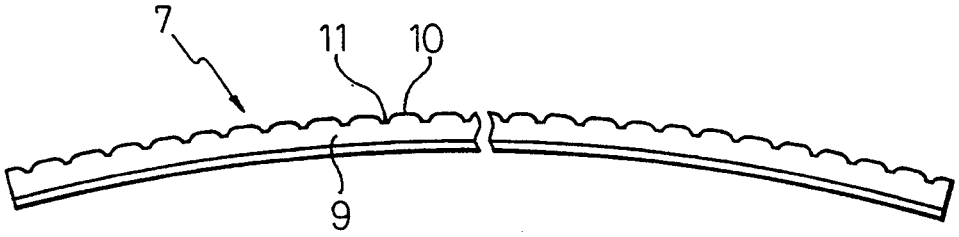
FIG. 15 is a partial side view of a header plate, illustrating a warping of a product such as a header plate after completion of press working.

Accordingly, in the sizing process, the material 14 having passed through the bending and coining processes is subjected to a press working process correcting restoring the feeding pitch of the material 14 to a constant pitch. Since the amount of stretch of the plate-like material 14 is determined depending upon the thickness there, the planar bottom portion 10 having the plurality of concavities 11 is subjected to compression determined in response to a change in the thickness of the material 14 to thereby adjust the amount of longitudinal stretch of the material 14 at a constant level. At this stage, compression is also applied to the bent portions 9 to thereby stretch the bent portions 9 by the same amount as that of the concavities 11 of the planar bottom portion 10. Thus, when the material 14 is finally sheared into header plates 7, the header plates 7 are not warped as shown in FIG. 15. The compression applied to the bent portions 9 of the material 14 is adjusted by measuring the change in the width of the material 14.

When the material 14 is fed by the feeder means into the press working stage for carrying out the sizing process, it is compressed between the die 36 and the compressing punches 27, and between the die 36 and the compressing punch 28 in response to the closing of the upper and lower platens 24 and 31 as best shown in FIG. 10. Consequently, the bent portions 9 and the planar bottom portion 10 of the material 14 are compressed, respectively.

At this stage, as shown in FIGS. 10 and 11, the cam plate 34 is adjusted in response to a change in the width of the material 14 measured by the measuring unit 33. Therefore, the compression applied by the punches 27 to the bent portions 9 can be adjusted to an optimum level.

The compression applied by the punch 28 to the planar bottom portion 10 can be also adjusted by adjusting a cam plate (not shown in FIG. 10) in response to the thickness measuring data of the material 14 measured by the measuring unit 33.

The material 14 having passed through the sizing process is corrected so as to have the concavities 11 disposed at a constant spacing in the longitudinal direction of the material 14 due to equal longitudinal stretches of the bent portions 9 and the planar bottom portion 10 of the material 14.

(The perforating process for perforating tube-holes)

When the material 14 is subsequently fed by the feeder toward the press working stage 15 of the press for carrying out the perforating process, elliptical perforations 12 are formed in the concavities 11 of the planar bottom portion 10 by the operation of the perforating punches 40 as shown in FIGS. 6, 7, 12 and 13 in response to closing of the upper and lower platens 43 and 45.

(The pilot process)

When the material 14 is further fed by the feeder means toward the stage 15 for carrying out the pilot process, the two pilot punches are engaged in the two elliptical perforations 12 so as to prevent the material 14 from being shifted from the correct position suitable for final press working.

(The shearing and perforating processes)

When the material 14 is fed from the pilot process toward the stage 15 for carrying out the shearing and perforating processes, it is sheared into final products, i.e., the header plates 7 having a predetermined length and a predetermined number of elliptical perforations 12. Simultaneously, the material is formed with the perforations 13 in the concavities 11 located adjacent to both longitudinal ends of the header plate 7.

In this stage 15, the perforations 13 are formed by the perforating punches 54 operated in response to the closing of the upper and lower platens 56 and 59 as shown in FIGS. 6, 7 and 14. The shearing punch 55 is also operated by the upper and lower platens 56 and 59 so as to shear the material 14 into a plurality of headed plates 7 having length as required and elliptical perforations 12 the number of which is determined by demand. Thus, the header plates 7 (FIGS. 4A through 5) having either even numbers or odd numbers of perforations 12, can be manufactured.

From the foregoing description of the preferred embodiment, it will be understood that in the press working of the plate-like material 14, when an amount of longitudinal stretch of the material 14 is adjusted in response to changes in the width and thickness of the material 14, it is possible to form a plurality of concavities 11 in the planar bottom portion 10 of the material 14 at constant spacings. Therefore, the position of the concavities 11 formed by the coining process in the material 14 can be accurately brought in registration with that of the elliptical perforations 12 formed by the predetermined perforating die and punches. Thus, the successively manufactured header plates 7 can constantly be provided with a plurality of elliptical perforations 12 at an accurately constant spacings for receiving the tubular elements 2. Further, the header plates 7 having a various different lengths can be successively manufactured by using a single press unit having a plurality of press working stages. Thus, production cost as well as maintenance fees required for the press unit can be low, resulting in lowering a manufacturing cost of the header plates 7. Moreover, in the manufacturing method according to the described embodiment, it is not necessary to change the dies and the associated tools. Therefore, no preparatory operation is needed for operating the press, and accordingly, the operation of the press unit is not interrupted during the press working operation. Therefore, a rate of operation of the press working tools including various dies, platens, die plates, punches, and so on can be enhanced.

In the foregoing description of the embodiment, the method for manufacturing long products from a lengthy strip-form material is adopted for manufacturing the header plates 7 used for assembling refrigerant condensers. Nevertheless, the method of the present invention is not intended to be exclusively used for manufacturing the header plates 7, and may be equally used for manufacturing header plates used for assembling a refrigerant super-cooler, a refrigerant evaporator, a heater core, a radiator, and an oil cooler and other heat exchanging units. The described manufacturing method may be applied for manufacturing long products other than the described header plates, which have various different lengths and various numbers of perforations. Further, the pilot process and the side-hole perforating process may be omitted as required.

Moreover, the forms of the concavities 11 and of the elliptical perforations 12 may be changed as required.

The U-shaped products finally sheared from the press-worked material may be further subjected to a bending process to form cylindrical products.

In the described embodiment, the cam plates 35, 50 and 64 are operated by air cylinders. Nevertheless, these cam plates 35, 50 and 64 may be operated by the other actuating means such as a solenoid-type actuator and an electric motor.

The automatic measuring unit 33 used to measure the thickness and width of the plate-like material 14 may be replaced with a manual measuring method in which the thickness and the width of a plate-like material is manually measured by an operator.

From the foregoing description, it will be understood that in accordance with the manufacturing method of the present invention, products having various lengths and various number of perforations are manufactured from a strip-like thin material by a single press unit provided with a plurality of press working stages. When the material is subjected to the various press working stages, the longitudinal stretch of the material can be adjusted by adjustably changing compression applied to the material depending upon the thickness and width of the material per se. Accordingly, the concavities formed in the material by compression can be disposed at constant spacings in the longitudinal direction of the material. Thus, irrespective of changes in the thickness and width of the material, the positions of the concavities formed by the coining process can be registered with positions in which the perforations are later formed by the perforating processes. Therefore, the perforations formed in the material are able to have a predetermined constant spacings.

Further, in accordance with the present invention, products having various desired lengths may be successively manufactured from a lengthy plate-like material by a single press unit. Thus, production costs as well as maintenance fees required for the press unit can be reduced, resulting in reduced manufacturing cost for the long products.

Moreover, in the method according to the present invention, it is not necessary to change the dies and the associated tools of the press unit. Therefore, no preparatory operation is needed for the operation of the press unit, and accordingly, the press unit may be operated without any interruption during the press working of the lengthy plate-like material. Therefore, a rate of operation of the press working tools including various dies, platens, die plates, punches, and so on can be greatly increased.

It should be understood that many variations and alternations of the present invention may occur to persons skilled in the art without departing from the scope and spirit of the invention covered by the accompanying claims.

We claim:

1. A method for manufacturing products having various substantial lengths, by press working, from a lengthy strip-like material of given thickness and width successively fed from a raw material source into a press means in a direction corresponding to a longitudinal direction of the strip-like material, comprising a plurality of successive pressing steps which include:

successively pressing the continuously fed lengthy strip-like material in a preforming step in a manner such that respective first predetermined longitudinal portions thereof are formed in a predetermined preliminary shape, respectively, said preforming step including bending of lateral opposite side portions of each said first predetermined longitudinal portion of said strip-like metallic material toward one another by applying a predetermined pressing force to said lateral opposite side portions in a direction corresponding to the thickness of the strip-like material to thereby form bent portions raising from a plane of the strip-like material;

successively compressing said respective predetermined longitudinal portions of the continuously fed lengthy strip-like metallic material having said predetermined preliminary shape by a force determined depending on the given thickness and width of the lengthy strip-like metallic material in a correcting step in in such a manner that the size of second predetermined longitudinal portions of said lengthy strip-like metallic material is corrected to thereby provide said second predetermined longitudinal portions with a desired amount of stretch in a direction corresponding to a direction of length of each said second predetermined portion of said lengthy strip-like metallic material; and perforating a plurality of perforations in predetermined positions of said lengthy strip-like metallic material after completion of the correcting step in a finishing step, said finishing step further including successively shearing said lengthy strip-like metallic material after said correcting and perforating steps so as to produce therefrom finished products having various lengths determined by demand.

2. a method for manufacturing products having various substantial lengths by press working according to claim 1, wherein said preforming step further comprises:

successively compressing said strip-like metallic material by predetermined dies at each of respective predetermined intermediate portions thereof extending between said bent portions in a coining step to thereby form concavities having a thickness less than said given thickness of said lengthy strip-like metallic material in a plurality of predetermined positions of said intermediate portion.

3. A method for manufacturing products having various substantial lengths by press working according to claim 2, wherein said correcting step comprises:

successively compressing said respective intermediate portions of said strip-like metallic material in a sizing process in such a manner that after completion of said coining process of said preforming step said respective intermediate portions are subjected to a compression determined in response to said given thickness of said lengthy strip-like metallic material, and said bent portions are further successively subjected to a different compression determined by said given width of said lengthy strip-like metallic material whereby said desired amount of stretch of said each second predetermined longitudinal portion is provided.

4. A method for manufacturing products having various substantial lengths by press working according to claim 3, wherein said finishing step comprises:

successively perforating said strip-like metallic material after completion of said sizing process by predetermined punches and dies in a perforating step in such a manner that said plurality of perforations is formed in said concavities of said intermediate portions thereof; and shearing said strip-like metallic material after completion of said perforating step so as to produce therefrom said finished products having a plurality of said perforations determined by demand and various lengths further determined by demand.

5. A method for manufacturing products having various substantial lengths by press working according to claim 4, wherein said plurality of perforations are formed in said concavities which are arranged at equidistant spacings.

6. A method for manufacturing products having various substantial lengths by press working according to claim 1, wherein said raw material source comprises a roll of strip-like metallic material of given thickness and width suitable for producing a plurality of header plates as said products.

7. A method for manufacturing products having various substantial lengths by press working according to claim 1, wherein said products having various substantial lengths are header plates used for assembling a refrigerant condenser for an air-conditioning apparatus.

8. A method for manufacturing products having various substantial lengths by press working according to claim 7, wherein said roll of strip-like metallic material of said raw material source for producing said header plates comprises a roll of aluminum alloy strip.

* * * * *